US005566966A

United States Patent [19]

Couderc et al.

[11] Patent Number: 5,566,966

[45] Date of Patent: Oct. 22, 1996

[54] DEVICE FOR MODIFYING THE PRESSURE DISTRIBUTION OF A SKI ALONG ITS SLIDING SURFACE

[75] Inventors: Bernard Couderc, Annecy; Pierre Szafranski, Pringy; Alain Bejean, Alby sur Cheran; Joel Arduin, Metz-Tessy, all of France

[73] Assignee: Salomon S.A., Metz-Tessy, France

[21] Appl. No.: 280,548

[22] Filed: Jul. 25, 1994

Related U.S. Application Data

[63] Continuation-in-part of Ser. No. 911,702, Jul. 10, 1992, Pat. No. 5,332,253.

[30] Foreign Application Priority Data

Aug. 27, 1991 [FR] France ..... 91 10895
Feb. 16, 1994 [FR] France ..... 94 01898

[51] Int. Cl.[6] ..... A63C 9/08

[52] U.S. Cl. ..... 280/602; 280/617; 280/633; 280/634

[58] Field of Search ..... 280/602, 607, 280/617, 618, 634, 633, 636

[56] References Cited

U.S. PATENT DOCUMENTS

| | | | |
|---|---|---|---|
| 2,258,046 | 10/1941 | Clement | 280/602 |
| 3,260,532 | 7/1966 | Heuvel | 280/602 |
| 4,139,214 | 2/1979 | Meyer | 280/607 |
| 4,568,100 | 2/1986 | Eriksson | 280/602 |
| 5,135,250 | 8/1992 | Abondance et al. | 280/617 |
| 5,303,950 | 4/1994 | Rigal et al. | 280/636 |
| 5,332,253 | 7/1994 | Couderc et al. | 280/602 |
| 5,360,229 | 11/1994 | Arduin et al. | 280/634 X |
| 5,397,149 | 3/1995 | Couderc et al. | 280/602 |

FOREIGN PATENT DOCUMENTS

| | | | |
|---|---|---|---|
| 1270867 | 6/1990 | Canada . | |
| 0182776 | 5/1986 | European Pat. Off. . | |
| 0183586 | 6/1986 | European Pat. Off. . | |
| 0409749 | 1/1991 | European Pat. Off. . | |
| 0556610 | 8/1993 | European Pat. Off. . | |
| 0567780 | 11/1993 | European Pat. Off. . | |
| 1109560 | 9/1955 | France | 280/602 |
| 1433242 | 12/1966 | France | 280/602 |
| 2338720 | 8/1977 | France . | |
| 2448360 | 10/1980 | France | 280/602 |
| WO88/01189 | 2/1988 | WIPO | 280/602 |
| WO93/11838 | 6/1993 | WIPO . | |
| WO93/14837 | 8/1993 | WIPO . | |

*Primary Examiner*—Christopher P. Ellis
*Attorney, Agent, or Firm*—Greenblum & Bernstein P.L.C.

[57] ABSTRACT

A device for modifying, dynamically, the pressure distribution of a ski, such as an alpine ski, along its sliding surface. The ski is equipped with front and rear binding elements and support elements for the front and rear ends of the sole of the boot. The device includes a sensor element in contact with the sole of the boot, and additionally, movable along a vertical direction, a flexion device to generate a flexional moment on at least one front or rear end of the ski, and a connection device between the sensor element and the flexion device to transmit, to the flexion device, at least one part of the vertical thrust of the boot sensed by the sensor element.

30 Claims, 15 Drawing Sheets

DEVICE FOR MODIFYING THE PRESSURE DISTRIBUTION OF A SKI ALONG ITS SLIDING SURFACE

CROSS-REFERENCE TO RELATED APPLICATION

This application is a continuation-in-part of application No. 07/911,702, filed on Jul. 10, 1992, now U.S. Pat. No. 5,332,253, issued on Jul. 26, 1994, the disclosure of which is hereby expressly incorporated by reference in its entirety.

BACKGROUND OF THE INVENTION

1. Field of the Invention

The invention is related to a device for modifying the pressure distribution of a ski, such as an alpine ski, along its sliding surface.

2. Description of Background and Material Information

Skis that are used for alpine skiing are constituted by relatively long boards, on which the boots of the skier are retained, most often by binding elements. The boots and the binding elements are located approximately in the median zone of the ski, commonly called the middle sole.

In the resting position, skis themselves have a natural arch; moreover, they have a certain flexibility. During skiing, the ski is deformed elastically to react to the various biases to which it is subject from the skier, and by reaction, from the surface on which it slides.

The main force to which the ski is subjected, originating from the skier, is generated by the weight of the skier. This weight is localized approximately in the middle sole zone of the ski.

The ski is also subject to biases by the binding elements. In fact, it is known that the binding elements pinch the boot. To do this, the rear binding element is generally slidably mounted, and it is returned elastically frontwardly by springs that are called return springs. The reaction to this pinching action is transmitted by the binding elements to the ski. This reaction is however different, depending on whether the front binding element or the rear binding element are each affixed to the ski, or whether the front binding element is affixed to the ski and the rear binding element is connected to the front binding element by a non-stretchable means, such as a blade or plate.

The ski is also influenced by the position of the skier, and whether the skier carries his or her weight at the front or at the rear of the skis.

It is known that the behavior of the ski and especially its movement on snow can be modified by influencing its arch, or by the longitudinal distribution of the ski on the snow. By playing with this pressure distribution, it is known that the characteristics of the ski can be modified to favor turning, or to favor gliding. That is, a ski's ability to turn easily or to have great stability during movement can be facilitated.

For skis that are currently on the market, pressure distribution of the ski on the snow is basically determined by the internal structure of the ski, and by the mode of assembly of the binding elements to the ski, that is, with or without a connection blade between the front and rear elements. The distribution of pressure can also be influenced by the intensity of thrust provided to the return spring.

Devices are known with an attached element that enable the pressure distribution of the ski on the snow to be modified. Thus, the European Patent Application 183,586 describes a blade made of an elastic material attached on top of the ski, between the binding elements and the ski. This blade has cursors in the area of its front end and its rear end, whereby a portion of the forces to which the ski is subjected is transmitted vertically. This device, however, has the disadvantage of providing only a modest performance at the cost of being substantially cumbersome. It is adapted for cases where both feet of the skier are in support on the same ski, to avoid the entire weight of the skier from being concentrated in the middle sole zone. It would be ill-adapted to a pair of traditional skis.

In European Patent Application No. 409,749 a device is disclosed that is constituted by a plate that is raised with respect to the upper surface of the ski, maintained between two longitudinal abutments. Elastic shock absorption means are positioned between the plate and the abutments, and the pre-stress exerted on the elastic means is adjustable. The bindings are mounted on the plate. This device gives good results, but its disadvantage is that the plate is raised with respect to the ski along its entire length. It thus behaves like a stiffener of the ski and, due to this fact, it disturbs the flexional movements of the ski. Moreover, the plate induces an identical pre-stress towards the front and towards the rear of the plate on the ski.

It must also be noted that these known devices induce a static type of modification of the pressure distribution on the ski, i.e., this induced modification is not influenced by the position of the skier on the skis during sliding.

SUMMARY OF THE INVENTION

One of the objects of the invention is to propose a device that enables a dynamic modification of the pressure distribution of the ski along its sliding surface, i.e., it takes into account the position of the skier on his or her skis.

Another object of the present invention is to provide a device that is less cumbersome.

Other objects and advantages of the present invention will become apparent upon reading the description that follows, this description being given, however, only as a non-limiting example.

The device, according to the invention, is intended to modify the pressure distribution of a ski, such as, notably an alpine ski, along its sliding surface, the ski being equipped with binding elements adapted to retain a boot and with at least one support element on which the sole of the boot rests. The device of the present invention includes:

a sensor element in contact with the sole of the boot, movable along a vertical direction, flexion means to generate a flexional moment on at least one of the front and rear ends of the ski tending to make the end plunge towards or away from the sliding surface, and connection means between the sensor element and the flexion means, to transmit to the flexion means, at least one portion of the vertical thrust of the boot sensed by the sensor element.

BRIEF DESCRIPTION OF THE DRAWING

The invention will be better understood with reference to the description that follows, as well as the annexed drawings that are an integral part of it, among which.

DETAILED DESCRIPTION OF THE PREFERRED EMBODIMENTS

Figure 1:
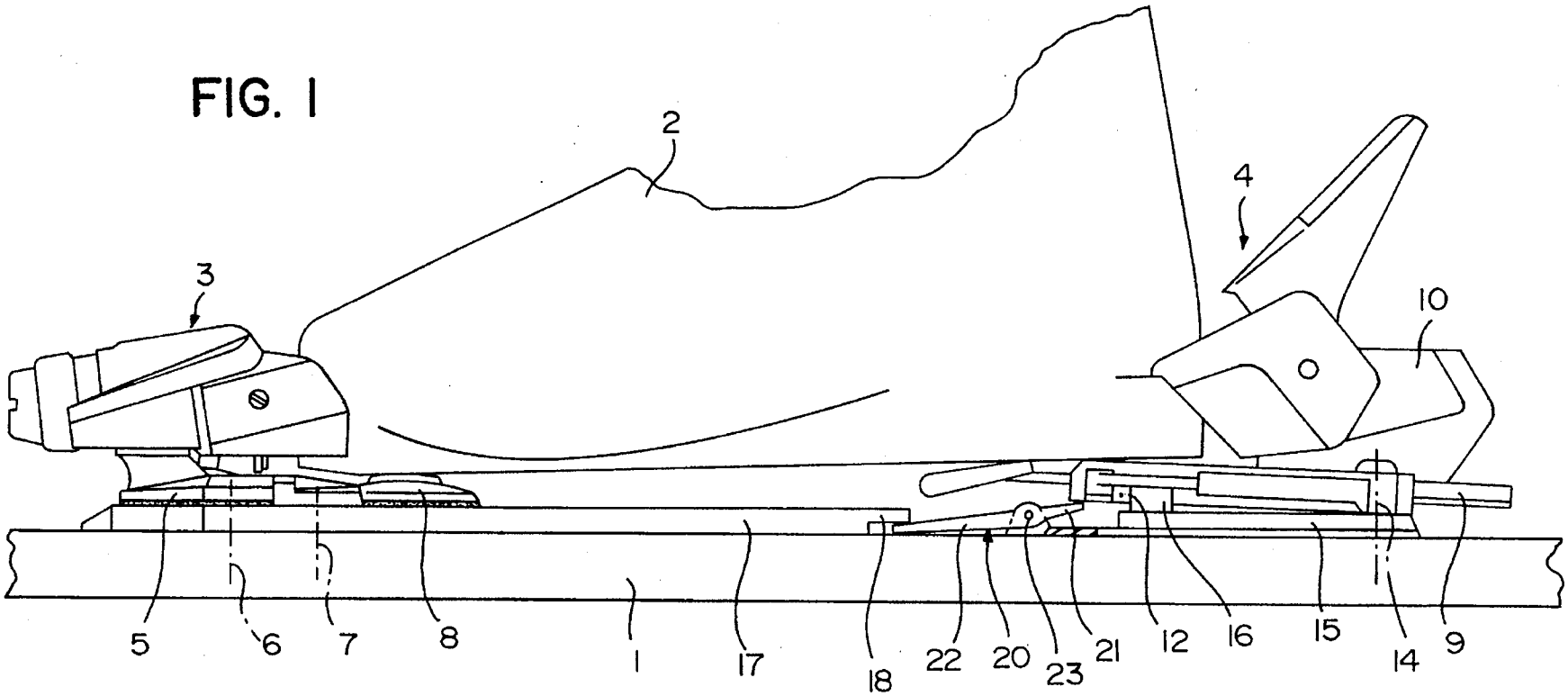
FIG. 1 is a side view that schematically illustrates the device according to a first embodiment of the invention.

FIG. 1 represents a partial view of a ski 1, shown in its middle sole median zone. Also represented by the reference numeral 2 is a ski boot, whose front and rear ends are respectively retained on ski 1 by a front binding element 3, and a rear binding element 4.

The front binding element 3 is of a known type, and it includes a base plate 5 that is assembled to the ski by any appropriate means, and notably by screws. These screws are not visible in FIG. 1, but their positioning has been represented by the dotted and dashed lines 6 and 7. The base plate 5 extends towards the rear by a support plate 8 on which the front end of the sole of the boot rests.

As for the rear binding element 4, it has a base plate 9 along which body 10 of the binding element can slide. This base plate 9 is assembled to the ski by means that are described below. Base plate 9 has, moreover, in its front portion, an extension 12 that acts as a support to the rear end of the sole of the boot.

The device according to the invention comprises a sensor which is in contact with the sole of the boot, and which is mobile along a vertical direction. In the embodiment illustrated in FIG. 1, the sensor is constituted by extension 12 of base plate 9. This extension supports the rear end of the boot. Additionally, base plate 9 is connected to ski 1 in such a way that it can oscillate substantially in a vertical plane. In the embodiment described, a support or wedge 15 is inserted between base plate 9 and ski 1. Wedge 15 is assembled to the ski by any appropriate means, and especially by screwing. Base plate 9 is assembled to ski 1 via wedge 15. The assembly means comprise the screws illustrated by reference numeral 14 located in the rear portion of base plate 9.

The openings of base plate 9 through which screws 14 pass are slightly oval along a longitudinal direction, such that base plate 9 can oscillate about screws 14 in the plane of FIG. 1. This oscillation movement has a reduced amplitude, and FIG. 1 represents base plate 9 in its uppermost position.

Figure 2:
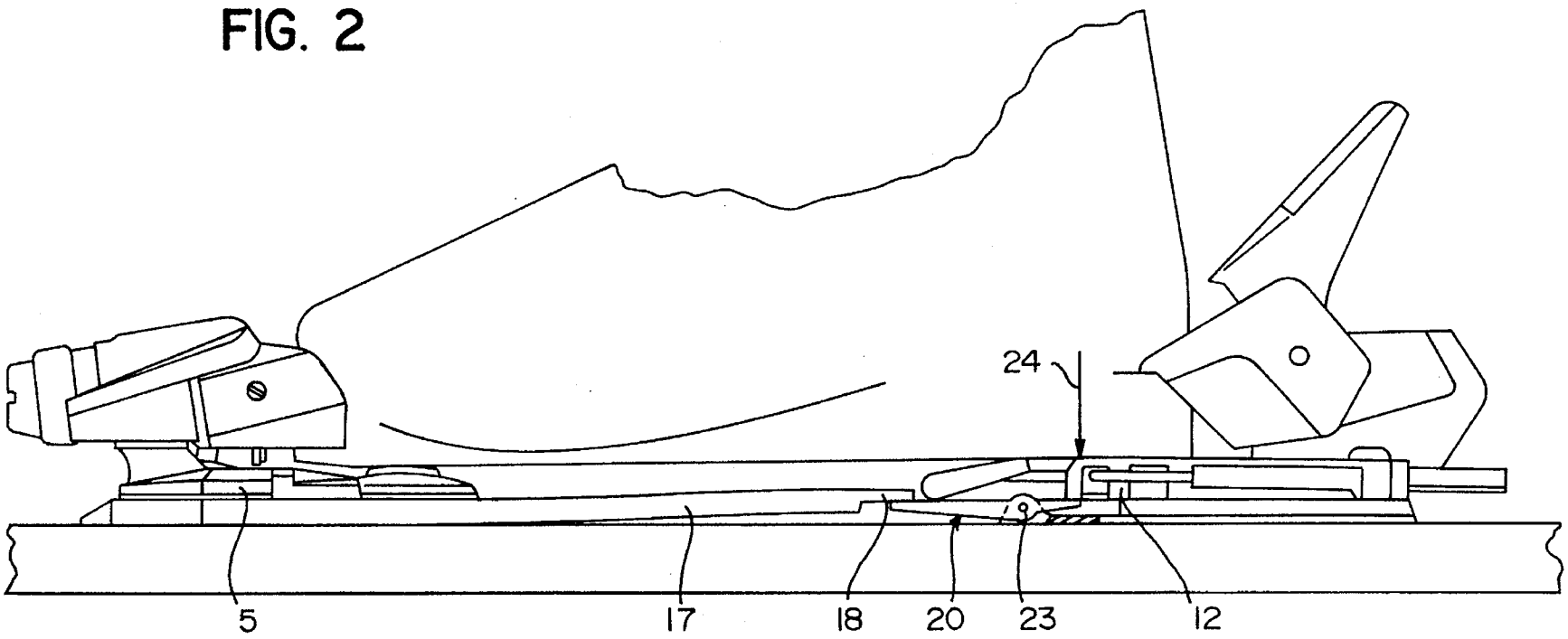
FIG. 2 is an explicative view of the operation of the device represented in FIG. 1.

In the front portion of base plate 9, lateral catches 16 affixed to wedge 15, guide the base plate laterally. Catches 16 also provide a vertical abutment for the front portion of base plate 9. Thus, extension 12 of base plate 9 can oscillate along a direction that is approximately vertical between the position that is represented in FIG. 1, and a position in which base plate 9 is pressed against wedge 15. This position is represented in FIG. 2.

Additionally, a longitudinal retention of base plate 9 is obtained by any appropriate means, for example, by lateral scallops of base plate 9 in which catches 16 are engaged.

Eventually, any appropriate elastically compressible material and/or a spring can be inserted between base plate 9 and wedge 15, or base plate 9 and the ski so as to elastically oppose a vertical downward movement of extension 12.

The embodiment described hereinabove is non-limiting, and any other appropriate means can be suitably used, provided that the sensor, constituted here by extension 12, is mobile along an approximately vertical direction.

Furthermore, the device according to the invention has flexion means to generate a flexional moment on at least one end of the ski. In the example given in FIG. 1, the flexion means act on the front end of the ski. They are constituted by a base 17, whose front end is positioned between base plate 5 and front binding element 3 and the upper surface of the ski. At this position, base plate 5 and the front portion of base 17 are assembled in an affixed manner to ski 1.

Base 17, which is, for example, constituted by a rigid platform, extends towards the rear where it has a free end 18. In the resting position, base 17 is automatically pressed against the upper surface of the ski.

It is understood that if an upward vertical bias is exerted on free end 18, this bias will be transmitted to the ski in the zone of base plate 5 of front binding element 3, in the form of a flexional moment tending to make the front end of the ski plunge downwardly.

The device according to the invention also comprises connection means between the sensor, constituted by extension 12 and free end 18 of base 17.

In FIG. 1, these means are constituted by a rocking means 20 with two arms, one arm 21 being engaged beneath the sensor, i.e., at the front end of extension 12, and the other arm 22, being engaged beneath free end 18 of base 17.

The functioning of the device according to the invention is as follows. In the normal position of the skier, illustrated in FIG. 1, sensor 12 remains in a raised position or near this position, and base 17 produces a zero or a relatively weak flexional moment at the level of the front end of the ski.

FIG. 2 illustrates a rear support position of the skier. The rear end of the sole of the boot generates an additional force, represented by arrow 24, on sensor 12. Under the effect of this force, the sensor falls, which results in the pivoting of rocking means 20 about its axis 23. This pivoting results in the raising of free end 18 of base 17, which then results in an additional flexional moment at the level of base 5, which tends to make the front end of the ski plunge. As soon as the skier comes back into a normal support position, the device returns to the position illustrated in FIG. 1, and the additional flexional moment on the front end of the ski disappears.

It is understood that the conditions under which this moment is exerted can be varied by modifying the parameters of the different means, for example the length of the lever arms and the position of the axes.

Figure 3:
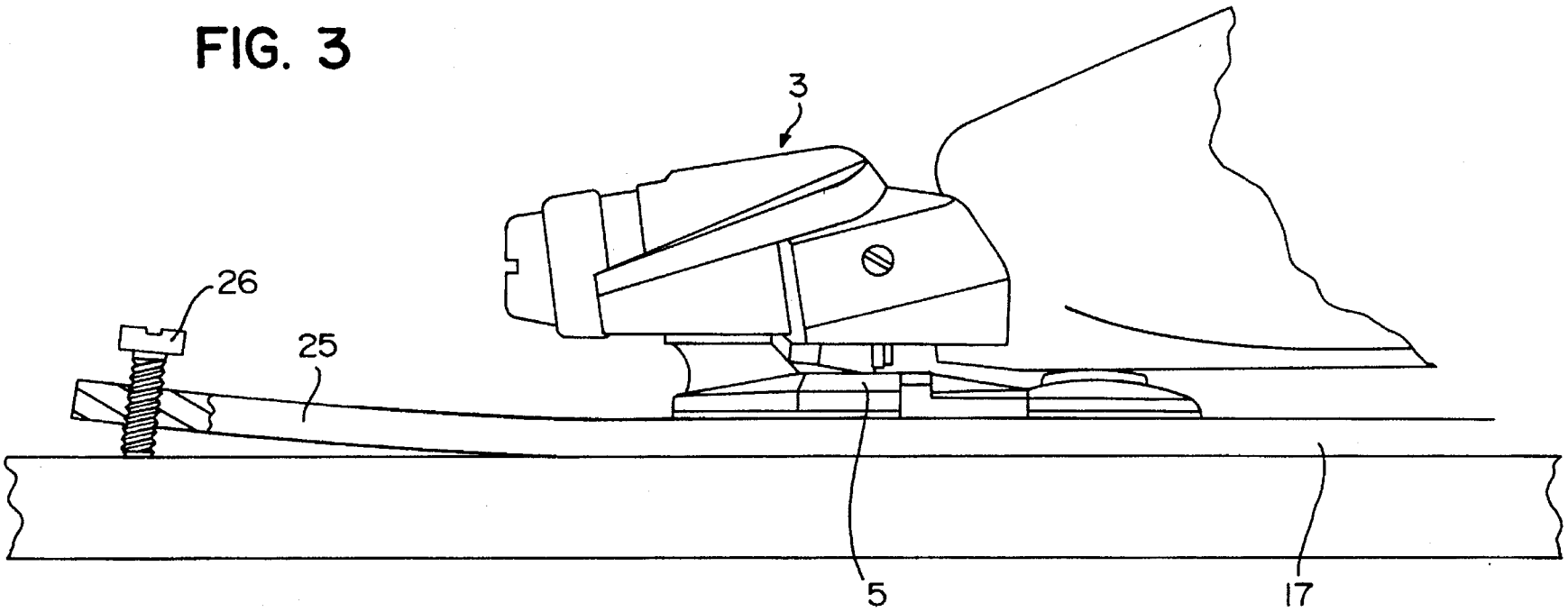
FIG. 3 represents a side view of a variation of the device of FIG. 1.

FIG. 3 illustrates a variation of the embodiment of the preceding device. According to this variation, base 17 is extended frontwardly beyond base plate 5 of front element 3. Base 17 thus has one end 25 offset towards the front. At the end 25, a screw 26 or any other appropriate means that performs the same or substantially the same function as the screw, to be described, ensures a connection by support between base 17 and the upper surface of the ski. Screw 26 enables, on the one hand, to offset on the front of the ski, the biases to which the ski is subject from base 17. Screw 26 also enables a flexional pre-stress of the front end of the ski to be adjusted. The front end 25 of base 17 can have several openings to receive screws 26 at different positions along a longitudinal direction, or along a transverse direction.

Figure 4:
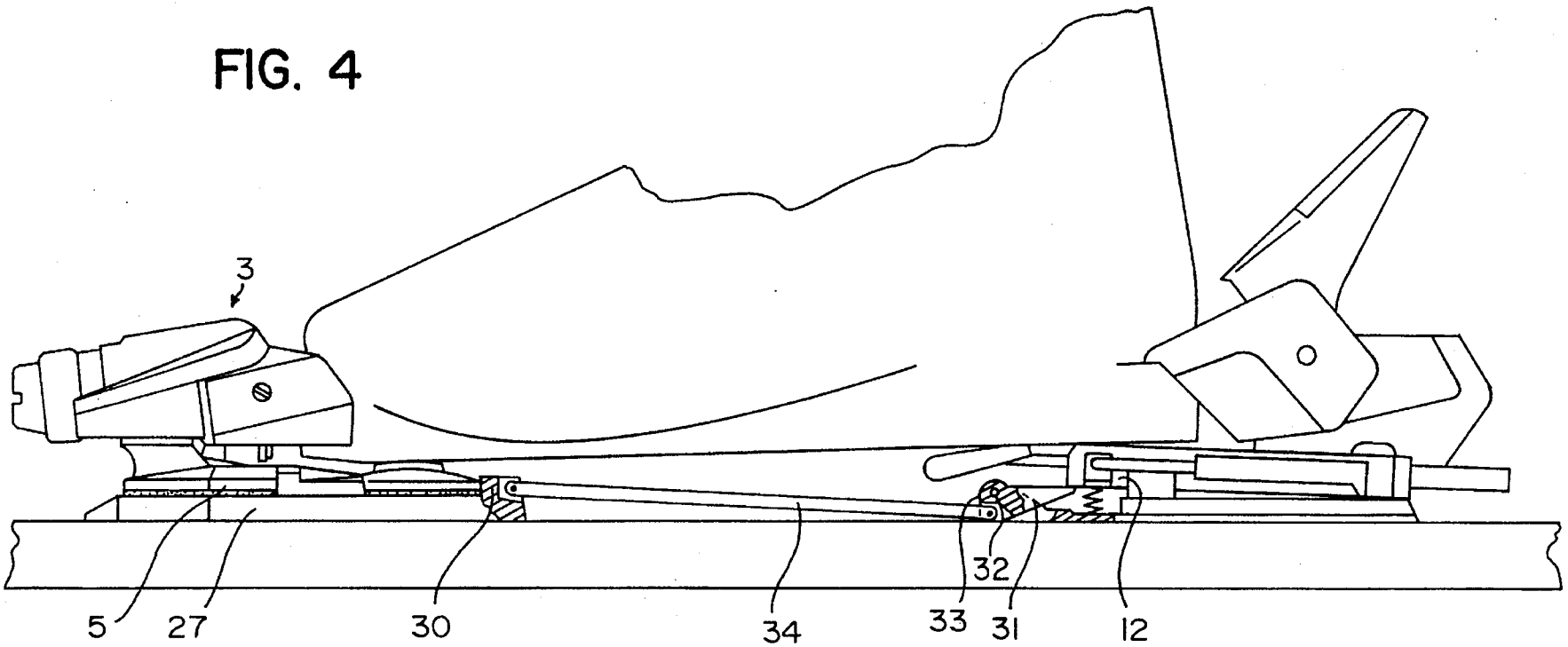
FIG. 4 represents, in a side view, the device according to another embodiment.

FIG. 4 illustrates another embodiment, generally including a variation of the flexion means and of the connection means.

The device represented in this figure comprises a base 27, whose front portion is positioned between base plate 5 of front element 3 and the upper surface of the ski. In its rear portion, base 27 has an edge 30 that rises along a substantially vertical direction, in the direction of the sole of the boot.

The connection means represented in FIG. 4 first comprise a small rocking element 31, journalled about the transverse axis 32. One of the branches of the rocking element 31 is engaged beneath extension 12, and the other branch of the rocking element is oriented in such a way so as to have a substantially vertical support surface 33 when in the resting position, said surface extending beneath journal axis 32.

A compression element 34 extends between the lower portion of this surface 33, and the upper surface of edge 30, such compression element being, for example, constituted by a bar or a compression blade. As can be seen in FIG. 4, compression element 34 is oblique.

The functioning of the device is as follows. A rear support of the boot is translated by a downward movement of extension 12, that results in a rotation of rocking element 31. The compression element 34 transmits this rotation to edge 30 of base 27 in the form of a compressing force oriented frontwardly. In light of the fact that the support point of element 34 on edge 30 is offset in height with respect to the upper surface of the ski, this bias generates a flexional moment on the front end of the ski, tending to make this end plunge downwardly.

Figure 5:
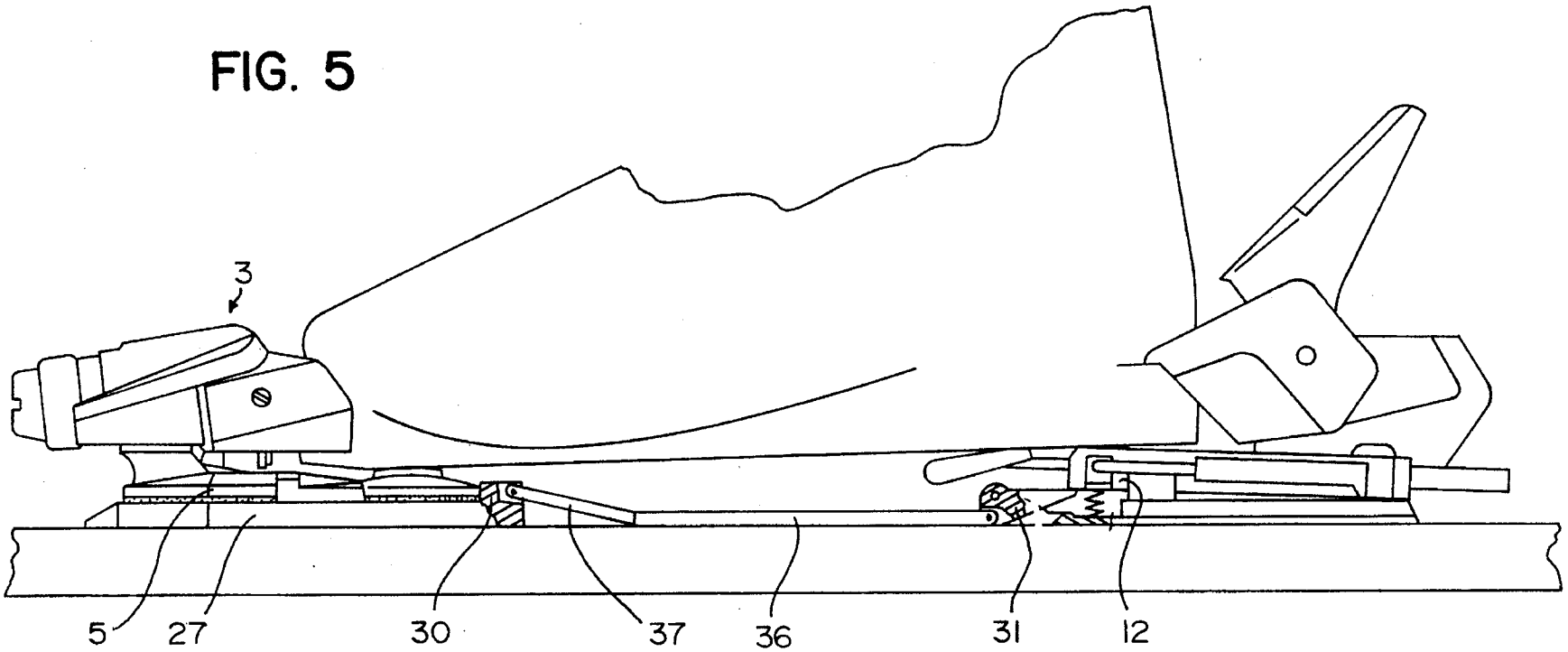
FIG. 5 illustrates a variation of the device of FIG. 4.

FIG. 5 represents a variation of the device of FIG. 4. According to this variation, the compression element is made of two portions, a rear portion 36 extending along the upper surface of the ski, and which is extended obliquely by a front portion 37. As in the preceding case, the front end of portion 37 is in support against edge 30 of base 27.

Figure 6:
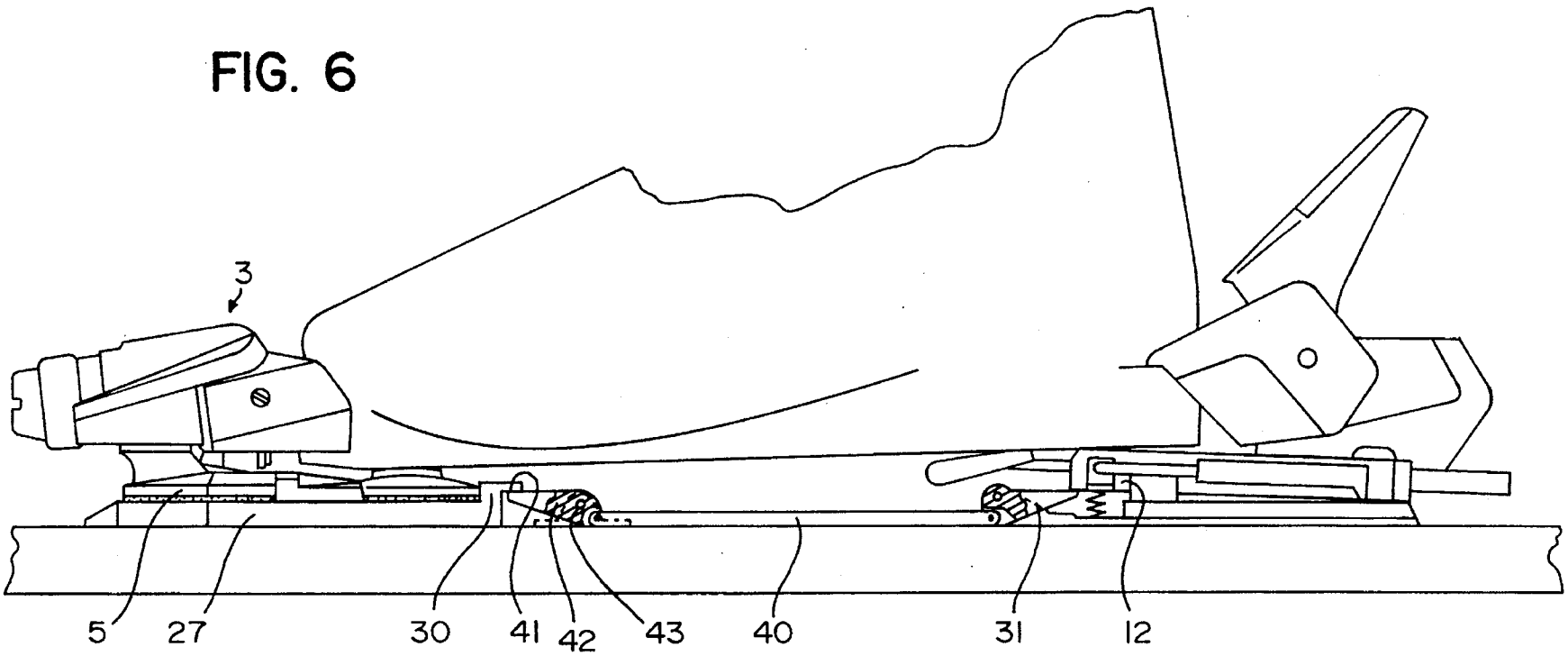
FIG. 6 illustrates another variation of the device of FIG. 4.

FIG. 6 represents another variation of the embodiment, according to which the compression element 40 extends along its entire length along the upper surface of the ski. In the front portion, edge 30 is extended rearwardly by a front spoiler 41, and a rocking element 42 journalled with an axis 43 connects the front end of the compression element 40, and front spoiler 41. Rocking element 42 is of the same type as rocking element 31 described previously.

A support of the boot on sensor 12 results in the rotation of rocking element 31, the translation of element 40, and the rotation of rocking element 42. This last rotation is transmitted to base 27 via front spoiler 41 in the form of an upward vertical bias.

Figure 7:
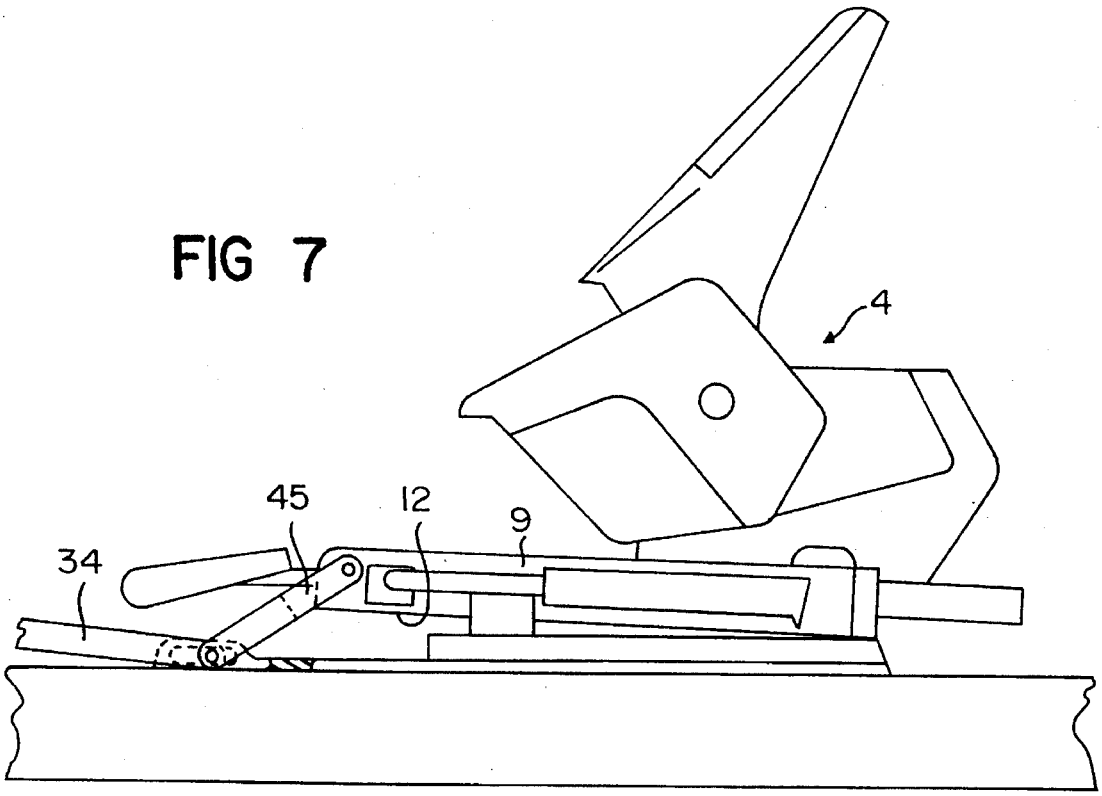
FIG. 7 represents a side view of a variation of the connection means.

FIG. 7 represents a variation of the embodiment. According to this variation, extension 12 is connected to the rear of compression element 34 by a control rod 45. The control rod is mounted obliquely, its rear end being connected, for example, by a journal to base plate 9 of rear element 4. Its front element is in support against the upper surface of the ski, or in the vicinity of such element. A support of the boot on sensor 12 is translated by a downward movement of extension 12, bringing about the rotation of control rod 45, and the displacement of its front end along an approximately longitudinal direction.

Figure 8:
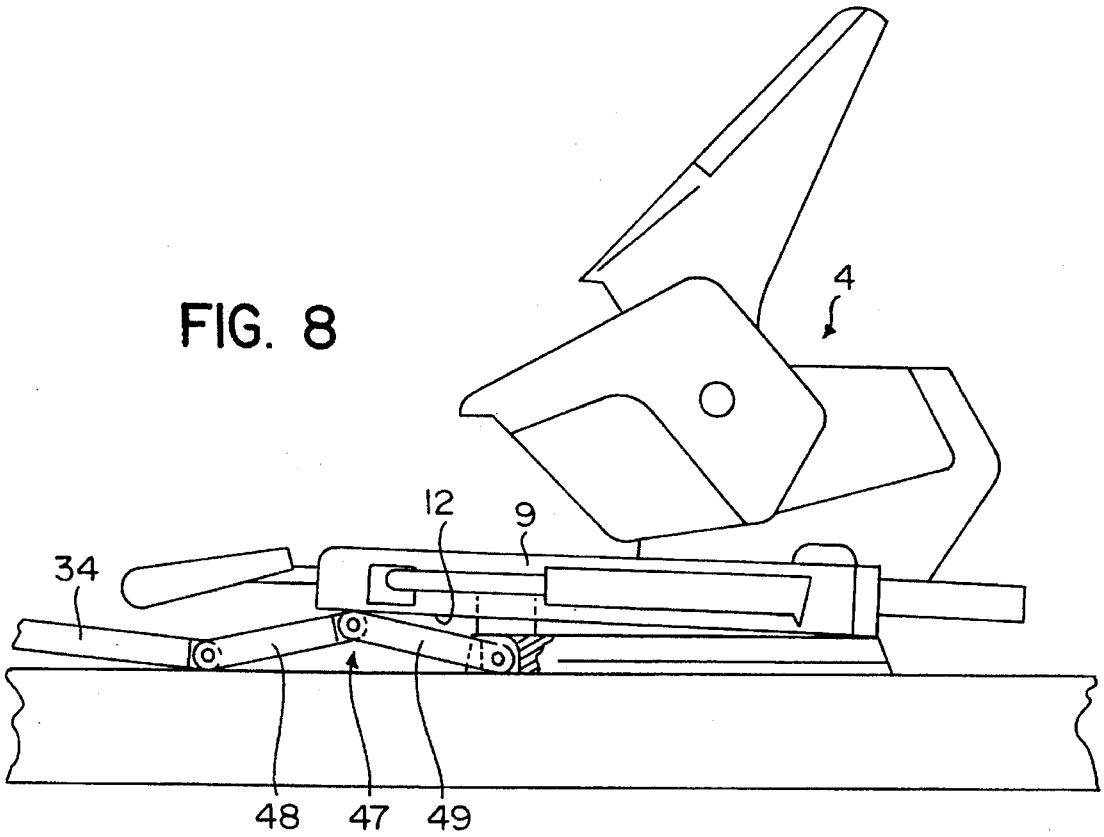
FIG. 8 represents a side view of another variation of the connection means.

FIG. 8 represents another variation according to which control rod 45, described previously, is replaced by a knuckle-joint device 47. The rear base plate 9 is in support, at the level of sensor 12, on the central journal of the two control rods 48 and 49 that constitute the knuckle-joint 47. A downward movement of sensor 12 is translated by a crushing of knuckle-joint 47, and a movement of the front end of the front control rod 48 along a longitudinal direction towards the front.

Figure 9:
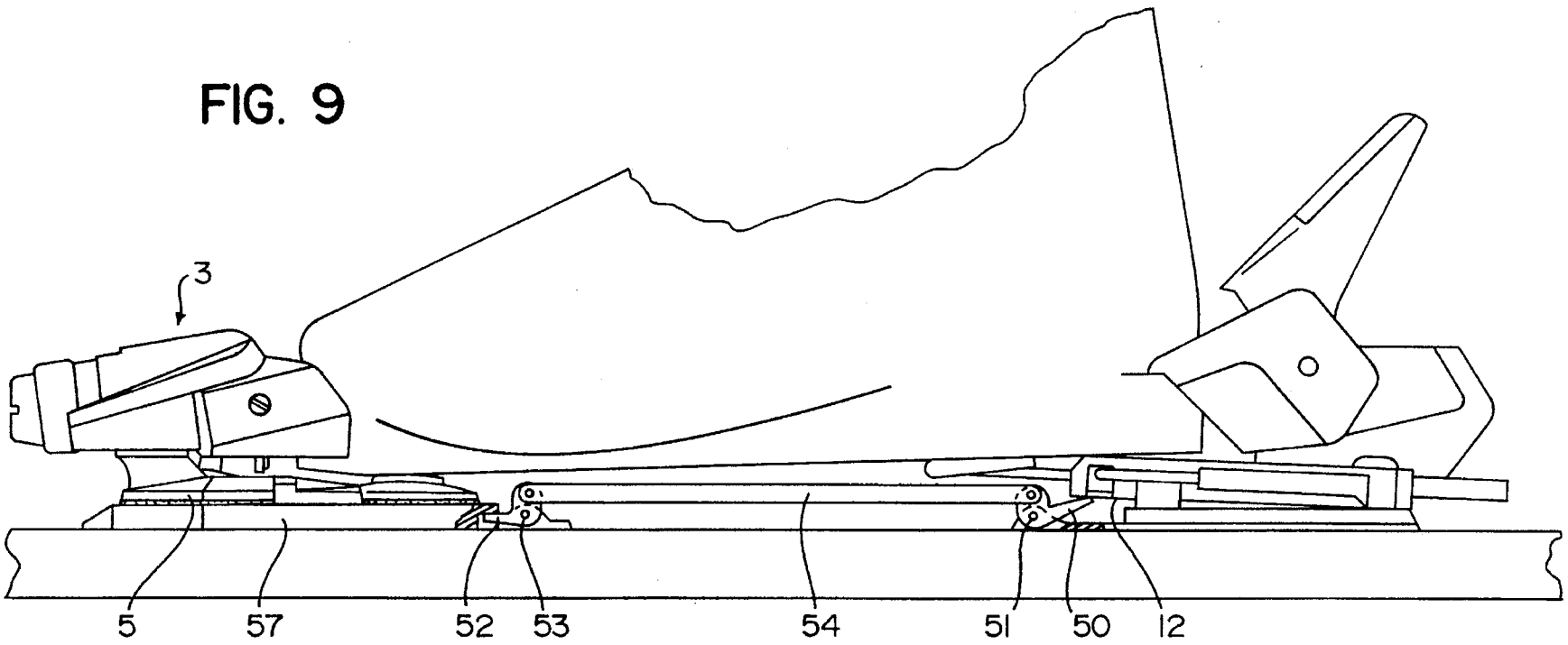
FIG. 9 is a side view of the device according to another embodiment.

FIG. 9 illustrates another embodiment of the invention. According to this embodiment, the connection means comprise towards the rear, a rocking element 50 journalled about a transverse axis 51. In the front portion, the connection means comprise a rocking element 52, journalled about a transverse axis 53. The two rocking elements 50 and 52 are connected by a non-stretchable connection 54, for example, a cable or a rod. Axes 51 and 53 are located in the lower portion of the respective rocking elements 50 and 52 in such a way that a downward movement of sensor 12 results in a rotation of rocking element 50, in a clockwise direction, which is transmitted by the non-stretchable connection 54 to rocking element 52. Rocking element 52 is driven rotationally about its axis 53, and this rotation results in a vertical upward bias on the rear end of base 57 located beneath base plate 5 of front element 3.

Figure 11:
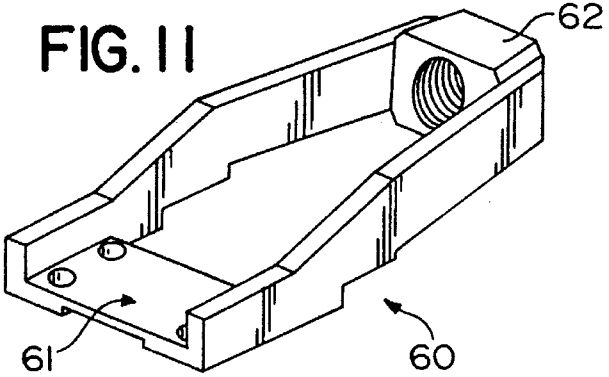
FIGS. 11 and 12 illustrate the details of the embodiment of the device of FIG. 10.
Figure 12:
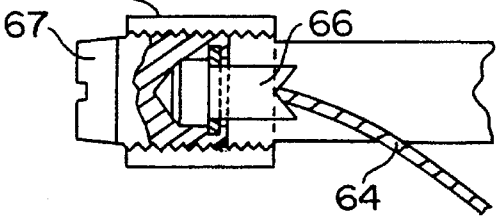
Figure 10:
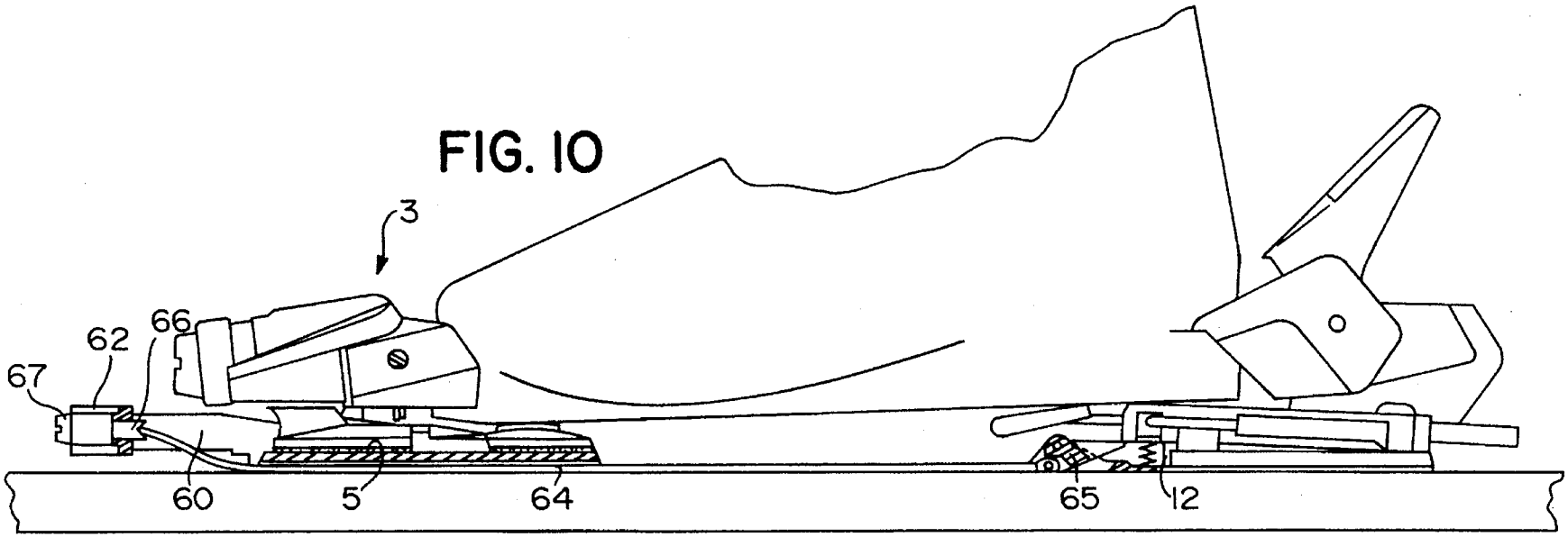
FIG. 10 is a side view of the device according to another embodiment of the invention.

FIG. 10 represents a variation of the embodiment of the device described in FIG. 4. The flexion means are constituted here by a stirrup 60, which is represented in FIG. 11. Stirrup 60 has a base 61 which is positioned between base plate 5 of front element 3 and the upper surface of the ski. Additionally, the stirrup has a central portion 62 which is raised with respect to the upper surface of the ski. The compression element is a compression blade 64, for example, a blade made of composite material, that can work in compression, and that has, moreover, flexional characteristics. Blade 64 is connected at the rear to a rocking element 65 similar to rocking element 31 of FIG. 4. From this end, blade 64 extends against the upper surface of the ski, passes beneath base plate 5. The front end of plate 64 is offset towards the top, and is in support against an abutment 66 which is affixed to the central portion 62 of stirrup 60. The longitudinal position of abutment 66 can be adjusted by a threaded stopper 67.

The functioning of this device is as follows. A thrust from the boot on sensor 12 is translated by a rotation of rocking element 65. This rotation results in a translation of blade 64 along a frontward longitudinal direction, thus resulting in a compressing bias exerted by the front end of blade 64 on abutment 66. This bias produces a flexional moment at the level of base plate 5 of front element 3, which tends to make the front end of the ski plunge downwardly.

It is understood that rocking element 65 can be replaced by any other device, for example those that have been described in FIGS. 7 and 8.

Figure 13:
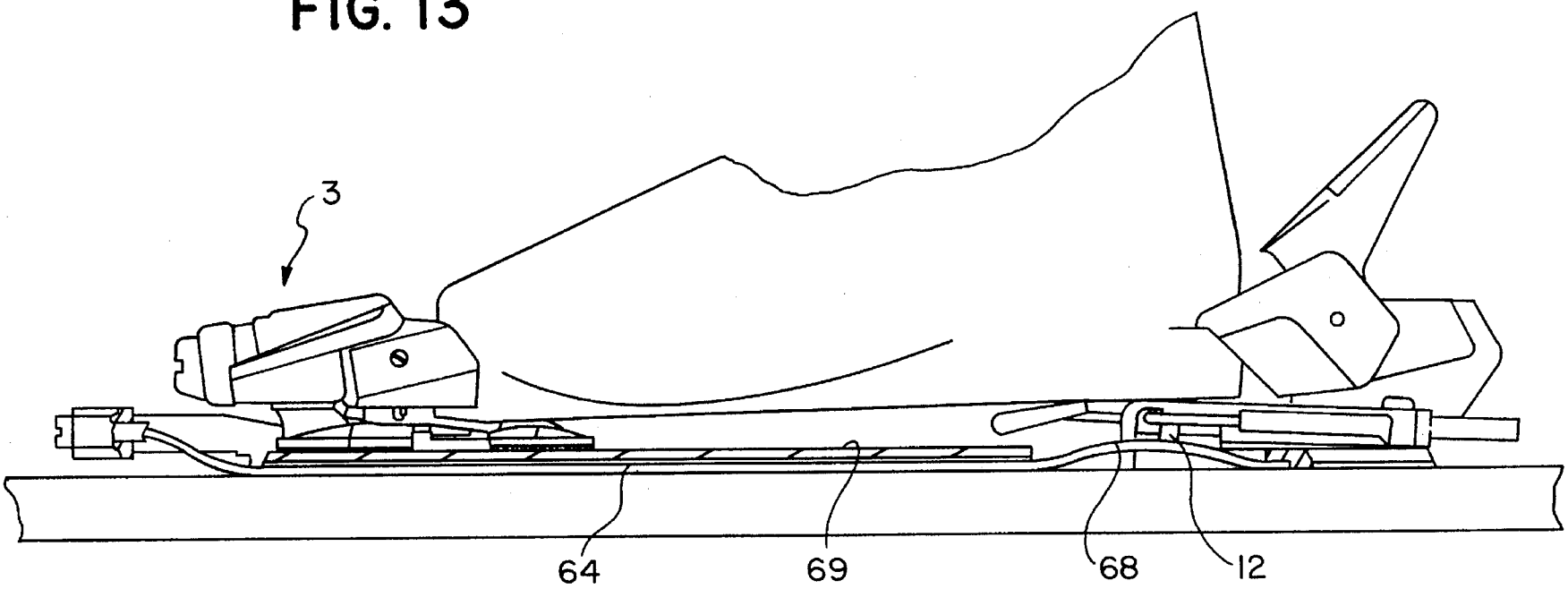
FIG. 13 illustrates the variation of the device of FIG. 10.

FIG. 13 represents another variation of the device according to which blade 64 is guided in the central portion of its length beneath a spoiler 69. Rear end 68 of the blade, which is located beneath sensor 12 is deformed towards the top by buckling. Pressure from the boot exerted on the sensor tends to resorb the buckling deformation of end 68, and results in, as in the proceeding case, a translation of blade 64 towards the front.

The foregoing description is only given as an examples, and other embodiments of the invention can be envisioned without leaving the scope of the invention.

Particularly, it is understood that sensor 12 can be independent, that is, disassociated from base plate 9.

In this case, the base plate 9 would be affixed to the ski, and the boot would rest on sensor 12, with the possibility of a downward bias of the sensor.

Additionally, the means that have been described tend to make the front portion of the ski flex. It is understood, that in the same way, flexion could be exerted on the rear portion of the ski.

All that would be required would be the inversion of the flexion means and the sensor between the front element and the rear element.

FIGS. 14–18 represent embodiments of the invention whereby a flexional moment is produced at at least one end of the ski tending to make the end move upwardly.

Figure 14:
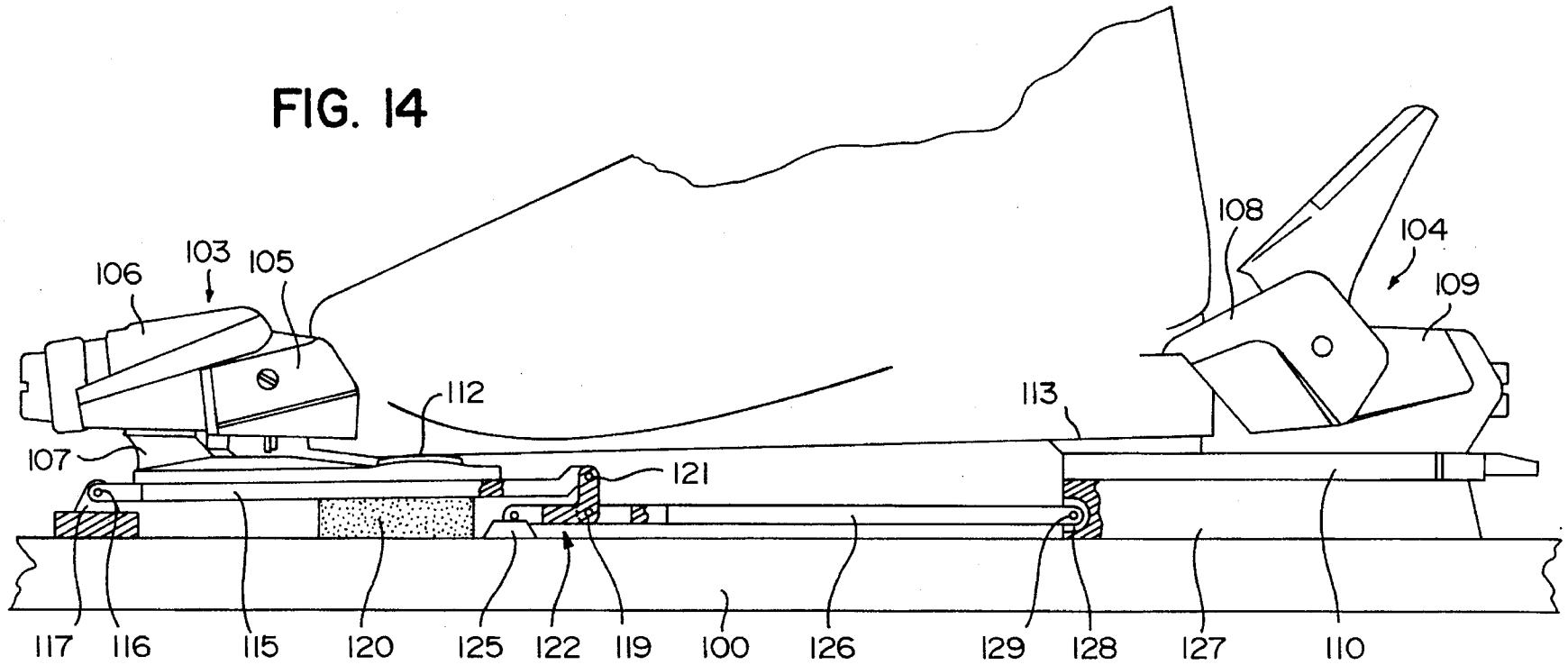
FIG. 14 is a side view of a device according to another embodiment of the invention.

FIG. 14 represents a side view of a ski 100 in its median zone. Binding elements 103 and 104 are mounted on the ski in this median zone.

Binding elements 103 and 104 are of any appropriate type and are especially similar to previously mentioned elements 3 and 4.

Each binding element 103, 104 is also associated with a support element 112, 113, on which the sole of the boot rests.

The interface device between the ski boot and the ski is located in the median zone of the ski.

The device comprises a sensor, movable along a generally vertical direction. In the embodiment illustrated in FIG. 14, the sensor is formed by the support element 112 on which the front end of the sole of the boot rests.

In a known manner, support element 112 rearwardly extends the base 107 of the binding element 103, and the assembly formed by the base 107 and the support element 112 is mounted on a base plate 115 which is journalled in its front portion about a traverse axle or pin 116 borne by a bearing 117, fixedly connected to the ski.

Figure 15:
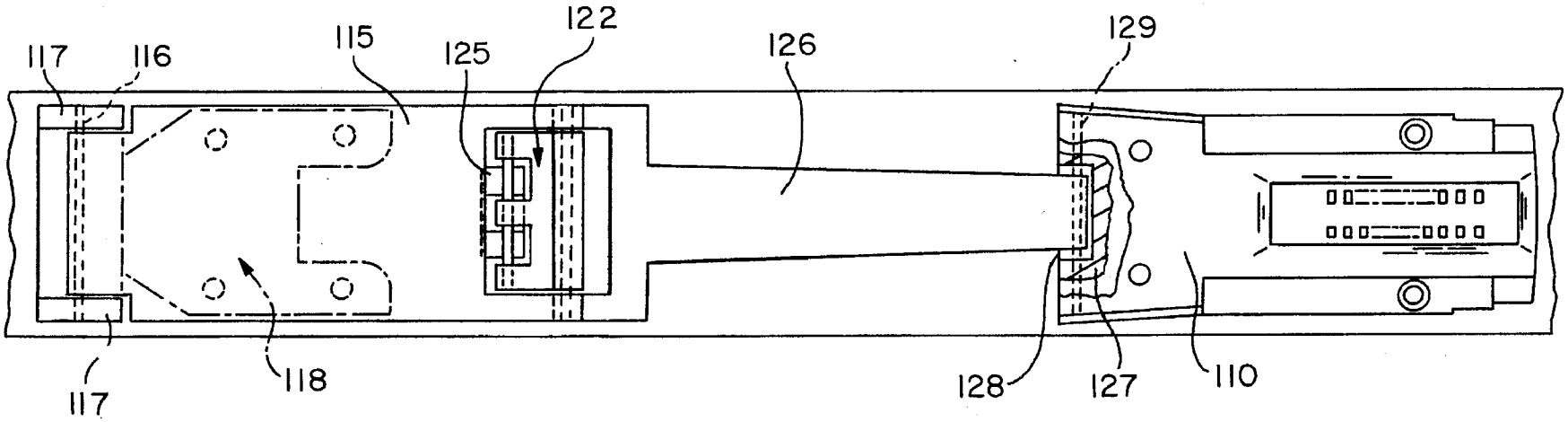
FIG. 15 is a top view of the device of FIG. 14.

As is visible in FIG. 15, base plate 115 has a generally rectangular shape, extending approximately in a horizontal plane, and has at its upper surface a mounting zone 118 on which the front binding element is assembled. The base plate is of a non-stretchable nature so as to transmit to the ski, by means of axle 116 and bearing 117, the tractional biases which are applied to its rear end.

Journal axle 116 is preferably elevated with respect to the upper surface of the ski, and base plate 115 is itself elevated with respect to the upper surface of the ski.

Possibly, a shock absorption means, such as a block 120 made of elastically deformable material, is inserted between the upper surface of the ski and the base plate 115. The material can have shock-absorbing or viscoelastic properties. Block 120 contributes to maintaining the base plate 115 in a horizontal position, and it elastically opposes the rotation thereof about axis 116. Any other journal means other than a journal axle would be suitable to ensure the substantially vertical movement of the rear end of the base plate 115 and the sensor 112.

The rear portion of the base plate 115 is connected by a journal about a transverse axis 121 to a rocking element 122.

The function of the rocking element 122 is to return the vertical forces applied on sensor 112 towards the base plate 115, along a horizontal direction.

Rocking element 122 has two approximately perpendicular arms, one approximately vertical arm 123 and one approximately horizontal arm 124.

In the position where the rocking element is represented, journal axis 121 with base plate 115 is located at the top of vertical arm 123. Horizontal arm 124 extends forwardly and its front end is in support against a support 125 which is fixedly connected to the ski. Preferably, the support 125 of the rocking element is advantageously materialized by a transverse pin **124*a* located at the front end of arm 124. This pin facilitates the rotation of the rocking element 122 on support 125**.

The lower end of vertical arm 123 of the rocking element 122 is retained along a horizontal direction by a longitudinally extending traction member 126 which extends from the rear of the ski.

In the embodiment illustrated, traction member 126 is connected to rocking element 122 about an axis 119. Traction member 126 is of a non-stretchable nature. It is rearwardly connected to a rear base plate 127 which is located beneath base 110 of the rear binding element, and which is affixed to the ski. Its rear end penetrates into a housing 128 of base plate 127 and is connected to the base plate by a pin 129.

Any other appropriate connection means would also be suitable. In particular, since traction member 126 essentially works by traction, it is possible to obtain such traction member in the form of a non-stretchable, but deformable band/strip or cable. The journal connections of member 126 to the rocking element 122 and the base plate 127 could be replaced by affixing the ends of the band/strip or cable, respectively, to the rocking element and the base plate, the relative movement between these elements, required for the operation of the device, originates from the deformation of the band/strip or cable.

Also, the rear end of traction member 126 could be affixed not to rear base plate 127, but directly to the ski in front of the base plate, or even to base 110 of the binding element. It is important that traction 126 is connected to a fixed point on or with respect to the ski. The height at which traction member 126 is connected to the ski determines the effective lever arm with which a force conveyed by the traction member will be transmitted to the ski.

Thus, a vertical bias exerted on the sensor 112, during a front support in the turn initiation phase, for example, forces the rocking element 122 to rock with respect to the support 125 about the end of its horizontal arm 124. Since journal axis 119 at traction member 126 is retained from the rear, journal axis 121 is forced to move rearward, which induces a tractional bias in base plate 115 that is transmitted to the ski by bearing 117. In reaction, traction member 126 transmits a tractional bias towards the rear of the ski, which in turn induces a flexional moment on the rear end of the ski, which tends to raise the rear end of the ski. Further, block 120 is compressed.

Figure 16:
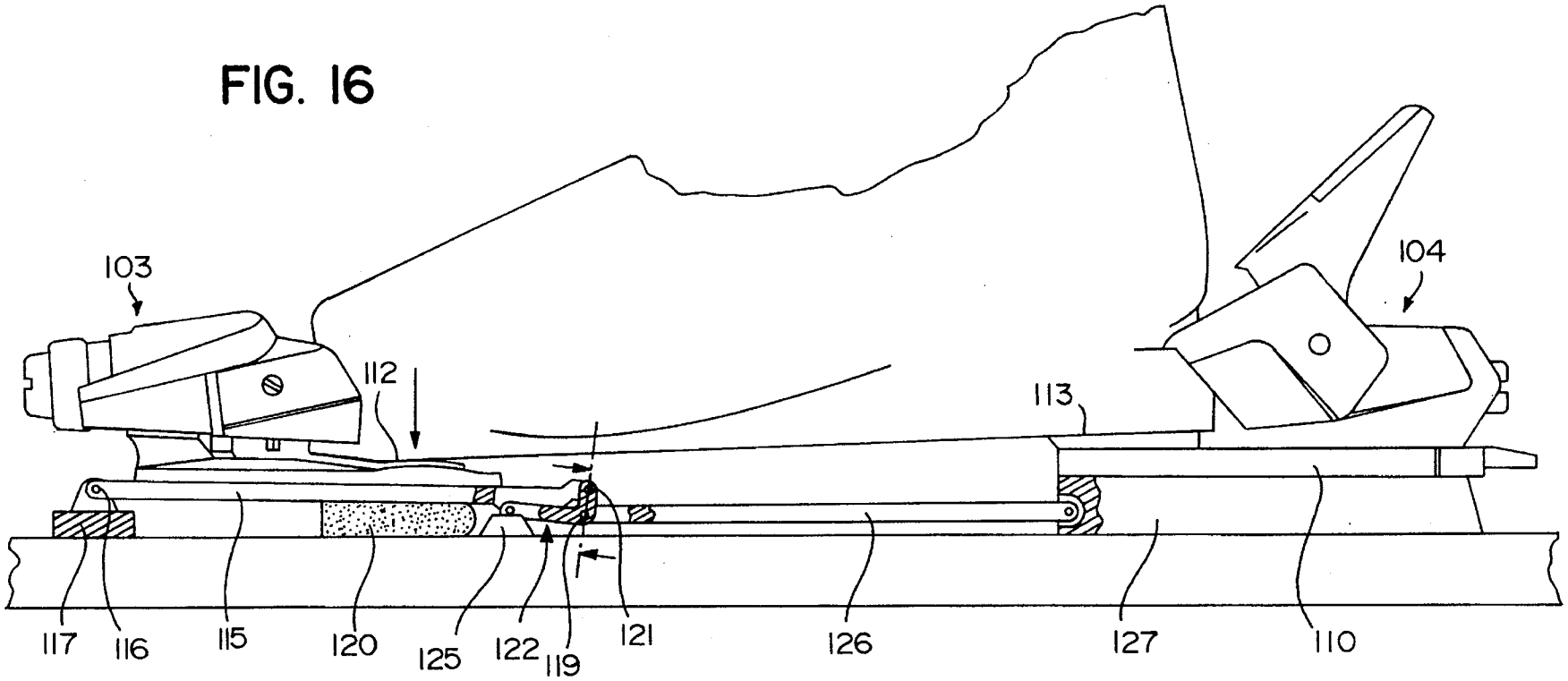
FIG. 16 is a partial exploded perspective view of the connection between the sensor and the various traction members for the device of FIG. 14.
Figure 17:
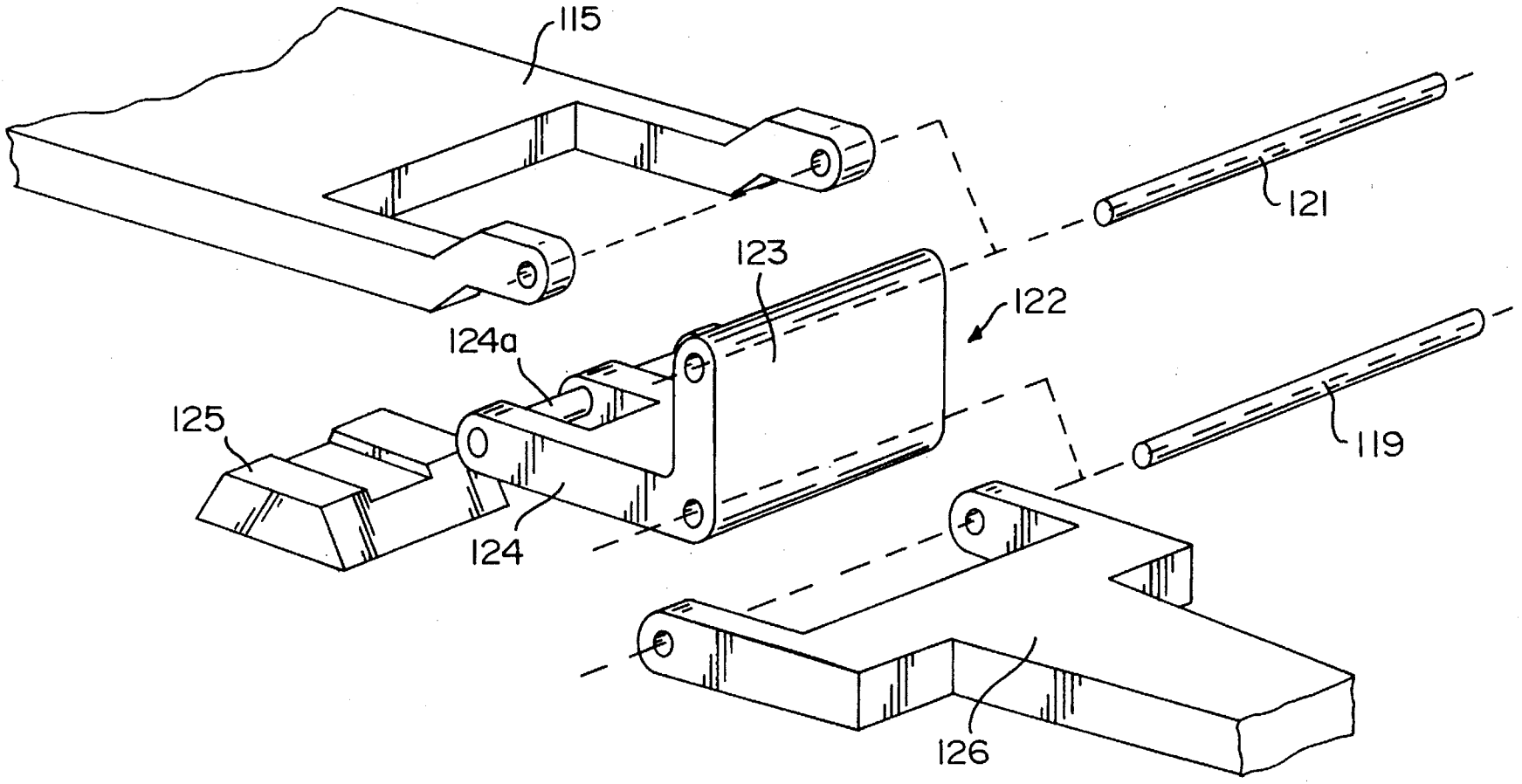
FIG. 17 is a side view of the device of FIG. 14, subject to a vertical force directed to the sensor.

FIG. 16 illustrates such a functioning of the device.

Since the journal of base plate 115 at bearing 117 is elevated with respect to the upper surface of the ski, this tractional bias induces in the ski a flexional moment which tends to turn up the shovel, and, if necessary, the rear end of the ski. Because of this, the ski is more pivotal.

The flexional moments induced on the front and rear of the ski are more or less strong depending upon the height of axis 116 and pin 129, respectively, with respect to the upper surface of the ski. In particular, if the rear end of member 126 is fixed directly to the upper surface of the ski, the flexional moment induced on the rear of the ski is negligible, and only the front end of the ski is biased upwardly.

One could also adopt a reverse position of the rocking element 122, i.e., orient the horizontal arm 124 rearwardly, and invert the position of the journals at the base plate and the traction member. However, it is preferable to place the journal as high as possible at base plate 115, so that the tractional bias has a vertical component which contributes to raising the shovel of the ski.

Figure 18:
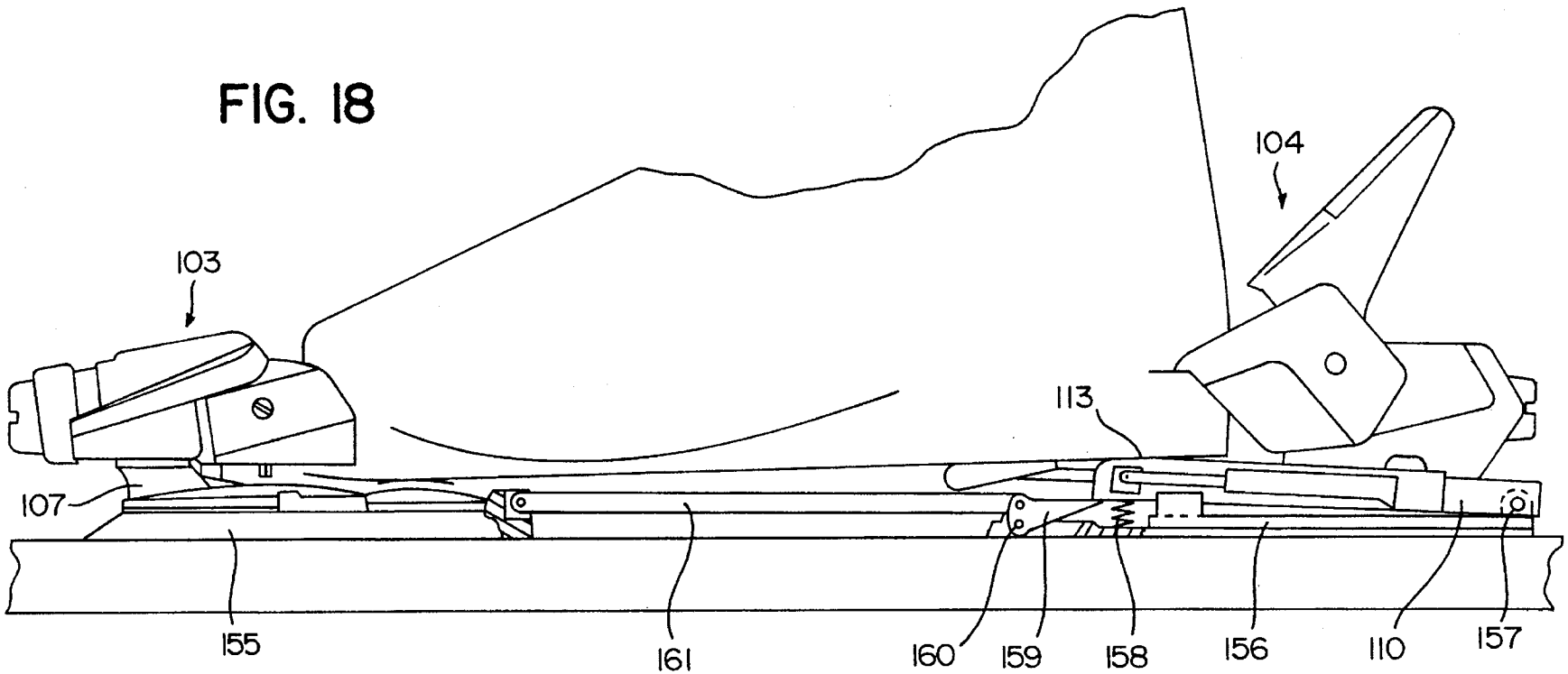
FIG. 18 is a side view of a variation of the embodiment of the invention shown in FIG. 14.

FIG. 18 represents an interface device associated with a front binding element 103 mounted on a base plate 155, fixedly connected to the upper surface of the ski. In addition, slide 110 of the rear binding element is mounted journalled about a transverse axis 157 borne by a base plate 156 affixed to the ski. Possibly, a spring 158 or another elastic means elastically opposes the downward rocking of slide 110.

The front portion of the base, which includes base plate 113, is maintained elevated, and it rests on the horizontal arm of a rocking element 159. The rocking element is journalled at its base with respect to the ski, for example, about an axis 160 borne by base plate 156.

A traction member 161 further connects rocking element 157 and base plate 155 so as to transform the vertical biases borne by support element 113 into rearward tractional biases exerted on base 155. As a variation, the traction member could be connected to an element affixed to the ski and separate from base 117 or base plate 115, a bearing, for example, such as bearing 117.

The foregoing description includes details of examples of the invention. Other embodiments of the invention can be envisioned without leaving the scope of the invention. For example, it is conceivable that certain of the concepts and details of certain of the several embodiments mentioned above and shown in FIGS. 1–13 could be employed in variations of the embodiments shown in FIGS. 14–18 without leaving the scope of the invention.

The instant application is based upon French patent application 91.10895 of Aug. 27, 1991 and French patent application 94.01898 of Feb. 16, 1994, the disclosures of which are hereby expressly incorporated by reference thereto, and the priorities of which are hereby claimed.

Finally, although the invention has been described with reference of particular means, materials and embodiments, it is to be understood that the invention is not limited to the particulars disclosed and extends to all equivalents within the scope of the claims.

What is claimed is:

1. A device for modifying the pressure distribution of an alpine ski along a sliding surface of the ski, the ski having a front end and a rear end, the ski being equipped with a first binding element and a second binding element adapted to retain a boot, and at least one support element on which the sole of the boot rests, said device comprising:

a sensor element for contact with the sole of the boot, movable along a vertical direction;

flexion means to generate a flexional moment on at least one of said front end and said rear end of the ski directed either upwardly or downwardly; and connection means connected between the sensor element and the flexion means for transmitting at least a portion of a vertical thrust of the boot captured by the sensor element to the flexion means for generating said flexional moment.

2. A device as defined by claim 1, wherein the flexion means comprises a base which is positioned between a base plate of one of the first and second binding elements and the ski, and wherein a longitudinal end of the base of the flexion means is a free end, said free end being biased by the connection means.

3. A device as defined by claim 2, wherein the base is extended towards a second of the first and second binding elements and wherein the free end of the base of the flexion means is biased vertically upwardly by the connection means.

4. A device as defined by claim 2, wherein one end of the base is offset towards the top with respect to the upper surface of the ski, and wherein said end is biased in compression by the connection means.

5. A device as defined by claim 1, wherein the sensor constitutes the support surface of one end of the boot, said support surface being associated to one of the binding elements.

6. A device as defined by claim 5, wherein the base plate of the binding element associated to the sensor is mounted rockably in a longitudinal and vertical plane, in such a way that the support surface of the boot can be lowered under the effect of the thrust of the boot oriented vertically downwardly.

7. A device as defined by claim 5, wherein the sensor constitutes the support surface of a rear part of the boot and is associated with a rear binding element.

8. A device as defined by claim 5, wherein the sensor constitutes the support surface of a front part of the boot and is associated with a front binding element.

9. A device as defined by claim 3, wherein the connection means comprise a rocking element with two arms, one arm being engaged beneath the free end of the base.

10. A device as defined by claim 4, wherein the connection means comprise a compression element adapted to transmit a compressing bias generated by the downward vertical movement of the sensor to the base.

11. A device as defined by claim 4, wherein the connection means comprise a non-stretchable element adapted to transmit a tractional bias generated by the downward vertical movement of the sensor to the base.

12. A device as defined by claim 2, wherein from the opposite side of its free end, the base is extended beyond the binding element to which it is connected, and that it has, beyond the base plate, a point of support against the upper surface of the ski.

13. A device as defined by claim 1 in combination with said first and second binding elements for securing a front end and a rear end, respectively, of the boot upon the ski.

14. A device as defined by claim 1, wherein the flexion means comprises means for generating a flexional moment upwardly on at least one of said front end and said rear end of the ski.

15. A device as defined by claim 2, wherein one end of the base is offset towards the top with respect to the upper surface of the ski, and wherein said end is biased in traction by the connection means.

16. A device as defined by claim 15, wherein the connection means comprise a traction element adapted to transmit a traction force generated by the downward vertical movement of the sensor to the base.

17. A device as defined by claim 15, wherein the connection means comprise a non-stretchable element adapted to transmit a tractional bias generated by the downward vertical movement of the sensor to the base.

18. An apparatus for modifying the pressure distribution of an alpine ski along a sliding surface of the ski, the ski having a front end portion and a rear end portion, the apparatus comprising:

a first binding element for securing a first end of a ski boot upon the ski;

a second binding element for securing a second end of the ski boot upon the ski;

means for generating a flexional moment at at least one of said front end portion and said rear end portion of the ski directed either upwardly or downwardly;

means associated with one of said first binding element and said second binding element for sensing a vertically directed force exerted by at least a portion of the ski boot; and means for transmitting at least a portion of said vertically directed force of the ski boot to said means for generating the flexional moment on the ski.

19. An apparatus according to claim 18, wherein said means for sensing a vertically directed force exerted by at least a portion of the ski boot comprises means for sensing a downwardly and vertically directed force exerted by at least a portion of the ski boot.

20. An apparatus according to claim 18, wherein said means for sensing a vertically directed force comprises means for sensing a vertically directed force exerted at a rear portion of the ski boot.

21. An apparatus according to claim 20, wherein said means for generating a flexional moment comprises means for generating a flexional moment at said front end portion of the ski and wherein said means for transmitting at least a portion of said vertically directed force of the ski boot comprises means for transmitting at least a portion of a vertically directed force at a rear portion of the ski boot to said means for generating a flexional moment at said front end portion of the ski.

22. An apparatus according to claim 18, wherein said means for sensing a vertically directed force comprises means for sensing a vertically directed force exerted at a front portion of the ski boot.

23. An apparatus according to claim 22, wherein said means for generating a flexional moment comprises means for generating a flexional moment at said rear end portion of the ski and wherein said means for transmitting at least a portion of said vertically directed force of the ski boot comprises means for transmitting at least a portion of a vertically directed force at a front portion of the ski boot to said means for generating a flexional moment at said rear end portion of the ski.

24. A device as defined by claim 18, wherein means for generating a flexional moment comprises means for generating an upwardly directed flexional moment on at least one of said front end and said rear end of the ski.

25. An apparatus for modifying the pressure distribution of an alpine ski along a sliding surface of the ski, the ski having a front end portion and a rear end portion, the apparatus comprising:

a first binding element for securing a first end of a ski boot upon the ski;

a second binding element for securing a second end of the ski boot upon the ski;

a flexion device for generating a flexional moment at at least one of said front end portion and said rear end portion of the ski directed either upwardly or downwardly;

a sensor mounted in functional cooperation with one of said first binding element and said second binding element for sensing a vertically directed force exerted by at least a portion of the ski boot; and a connection device for transmitting at least a portion of said vertically directed force of the ski boot to said means for generating the flexional moment on the ski.

26. An apparatus according to claim 25, wherein said sensor comprises means for sensing a downwardly and vertically directed force exerted by at least a portion of the ski boot.

27. An apparatus according to claim 25, wherein said sensor comprises means for sensing a vertically directed force exerted at a rear portion of the ski boot.

28. An apparatus according to claim 25, wherein said flexion device comprises means for generating a flexional moment at said front end portion of the ski and wherein said connection device comprises means for transmitting at least a portion of a vertically directed force at a rear portion of the ski boot to said means for generating a flexional moment at said front end portion of the ski.

29. An apparatus for modifying the pressure distribution of an alpine ski along a sliding surface of the ski, in which the ski has affixed thereto a front binding element and a rear binding element for retaining a front end of a boot and a rear end of a boot, respectively, upon the ski, and in which the ski has a front end portion and a rear end portion, the apparatus comprising:

a sensor for supporting at least one of the front end and the rear end of the boot, said sensor being mounted for movement in a generally vertical direction;

a flexion device for transmitting a flexional moment to at least one of said front end and said rear end of the ski directed either upwardly or downwardly; and a connection device connecting the sensor and the flexion device for transmitting at least a portion of a vertical force exerted during said movement of said sensor to the flexion device for generating said flexional moment.

30. An apparatus according to claim 29, wherein the flexion device for transmitting a flexional moment comprises a device for transmitting a flexional moment directed tending to force said one end of the ski upwardly.

* * * * *